US005850861A

United States Patent [19]

Silverberg

[11] Patent Number: 5,850,861

[45] Date of Patent: Dec. 22, 1998

[54] ELECTROSTATICALLY POSITIONED BLIND INSERT FOR INSULATED GLASS

[76] Inventor: Lawrence M. Silverberg, 113 Canberra Ct., Cary, N.C. 27512

[21] Appl. No.: 731,144

[22] Filed: Oct. 10, 1996

[51] Int. Cl.[6] ..... E06B 3/32

[52] U.S. Cl. ..... 160/107; 160/176.1 P; 49/74.1

[58] Field of Search ..... 160/168.1 P, 176.1 P, 160/107, 130, 166.1 R, DIG. 17; 52/171.3, 173.3, 473; 49/74.1, 92.1

[56] References Cited

U.S. PATENT DOCUMENTS

| | | | |
|---|---|---|---|
| 3,210,809 | 10/1965 | Streeter | 49/74.1 X |
| 3,384,147 | 5/1968 | Smith | 160/107 |
| 3,837,145 | 9/1974 | Festner | 55/146 |
| 3,860,055 | 1/1975 | Wild | 160/1 |
| 4,173,721 | 11/1979 | Louis | 307/115 |
| 4,593,218 | 6/1986 | Streeter | 160/176.1 X |
| 4,610,294 | 9/1986 | Anesi et al. | 160/331 |
| 4,684,911 | 8/1987 | Streeter | 160/176.1 P X |
| 4,956,588 | 9/1990 | Ming | 318/16 |
| 4,958,112 | 9/1990 | Zerillo | 318/280 |
| 5,307,082 | 4/1994 | Silverberg | 343/915 |
| 5,357,712 | 10/1994 | Streeter | 49/74.1 X |
| 5,511,601 | 4/1996 | Worthington | 160/176.1 |
| 5,532,560 | 7/1996 | Element et al. | 160/176.1 P X |

*Primary Examiner*—David M. Purol
*Attorney, Agent, or Firm*—Mills Law Firm PLLC; Clifford F. Rey

[57] ABSTRACT

An electrostatically controlled blind system for use in limiting the passage of light through windows, doors, and skylights in building structures is disclosed. The blind system comprises a plurality of elongated, electroconductive louvers which are pivotally supported within an electroconductive peripheral frame. The blind system is inserted between sheets of insulated glass having an electroconductive coating and is thereby insulated from the ambient atmosphere. A voltage converter converts alternating current to an electrostatic charge which is distributed on the surface of the louvers causing them to repel each other. The electrostatic charge on the louvers induces an opposite electrostatic charge on the grounded sheets of insulated glass creating an electrostatic force of attraction therebetween. The combined electrostatic force of repulsion between the louvers and the electrostatic force of attraction between the louvers and the insulated glass permit variable adjustment and remote control of the blind system.

8 Claims, 4 Drawing Sheets

ELECTROSTATICALLY POSITIONED BLIND INSERT FOR INSULATED GLASS

BACKGROUND OF INVENTION

Field of Invention

This invention relates to blind systems of the type used for blocking the passage of light through windows, and, more particularly, to an electrostatically controlled blind system for use in conjunction with insulated glass in windows, doors, skylights, and partitions.

Manually operated blind systems that regulate the passage of light through windows in a building structure are well known to those skilled in the art. Such a conventional blind system is a relatively simple mechanical device including a plurality of elongated, horizontally disposed louvers of equal length and width arranged in a vertical column such that each louver overlaps the abutting edge of each adjacent louver providing for complete closure of the window or other opening.

The individual louvers within the blind system are supported in generally parallel relation by a network of vertically disposed cords which are interconnected at regular intervals. A mechanical mechanism coupled to the cord network provides for pivoting movement of the individual louvers to limit the passage of light.

Typically, such blind systems may be drawn upwardly by a separate pull cord mechanism which effectively stacks the individual louvers together at the top of the window when it is desired to admit light.

Various improvements have been developed over the basic blind system to enhance the operation thereof. For example, U.S. Pat. No. 5,511, discloses an electrically powered mechanism for adjusting a blind system.

Other U.S. Pat. Nos. 4,173,721, 4,610,294, 4,958,112, and 4,956,588 describe electrically powered mechanisms for operating the pull cord of a blind system.

Although such electrically powered mechanisms enable the blind system to be remotely controlled, they are generally expensive to manufacture, install and repair. Further, whether manually or electrically operated, the cord network and other moving parts can wear prematurely and periodically malfunction.

Thus the present invention has been developed to solve these problems by utilizing electrostatic force to control the operation of a blind system

SUMMARY OF THE INVENTION

After much research and study of the above mentioned problem, the present invention has been developed to provide an electrostatically controlled blind system for insertion between panes of insulated glass utilized in windows, doors, skylights and partitions in residential and commercial buildings.

The blind system of the present invention comprises a plurality of electrically conductive louvers arranged in columns such that each louver overlaps the abutting edge of each adjacent louver thereby providing for closure of the window or other opening wherein the blind system is installed.

The individual louvers are adapted for pivoting movement about their longitudinal axes and are supported on a plurality of vertically disposed, electrically conductive louver support columns which extend through apertures formed within each louver.

The respective ends of each louver support column are installed in electrical contact within a peripheral support frame which forms part of a conventional insulated glass window structure.

The louvers, the louver support columns, and the peripheral frame so assembled are inserted between parallel panes of insulated glass and sealed therebetween to fours a closed air space around the louvers. The insulated glass panes are provided with an electroconductive coating and are electrically grounded.

An electrostatic charge is applied to the peripheral frame by an external power source and the electrostatic charge is distributed to the surface of the individual louvers.

Once the electrostatic charge has been distributed along the surface of the louvers, they will repel each other in a known manner. The electrostatic charge on the louvers also induces an opposite electrostatic charge on the grounded sheets of insulated glass when the glass is placed sufficiently close to the louvers thereby creating an electrostatic force of attraction between the louvers and the glass. The combined electrostatic force of repulsion between the individual louvers and the electrostatic force of attraction between the oppositely charged louvers and panes of glass results in the pivoting movement of the louvers which is critical to the present invention.

From the above, it can be seen that the present invention provides a method and apparatus for electrostatically controlling the operation of a blind system.

Another object of the present invention is to provide an electrostatically controlled blind system which eliminates numerous mechanical components such as pulleys and cords associated with the blind systems of the prior art.

Another object of the present invention is to provide an electrostatically controlled blind system which may be remotely operated by a user thereof.

Another object of the present invention is to provide an electrostatically controlled blind system which is adaptable for insertion into preexisting window openings in residential and commercial structures.

Another object of the present invention is to provide an electrostatically controlled blind system which can be fabricated from readily available materials at reasonable manufacturing costs.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
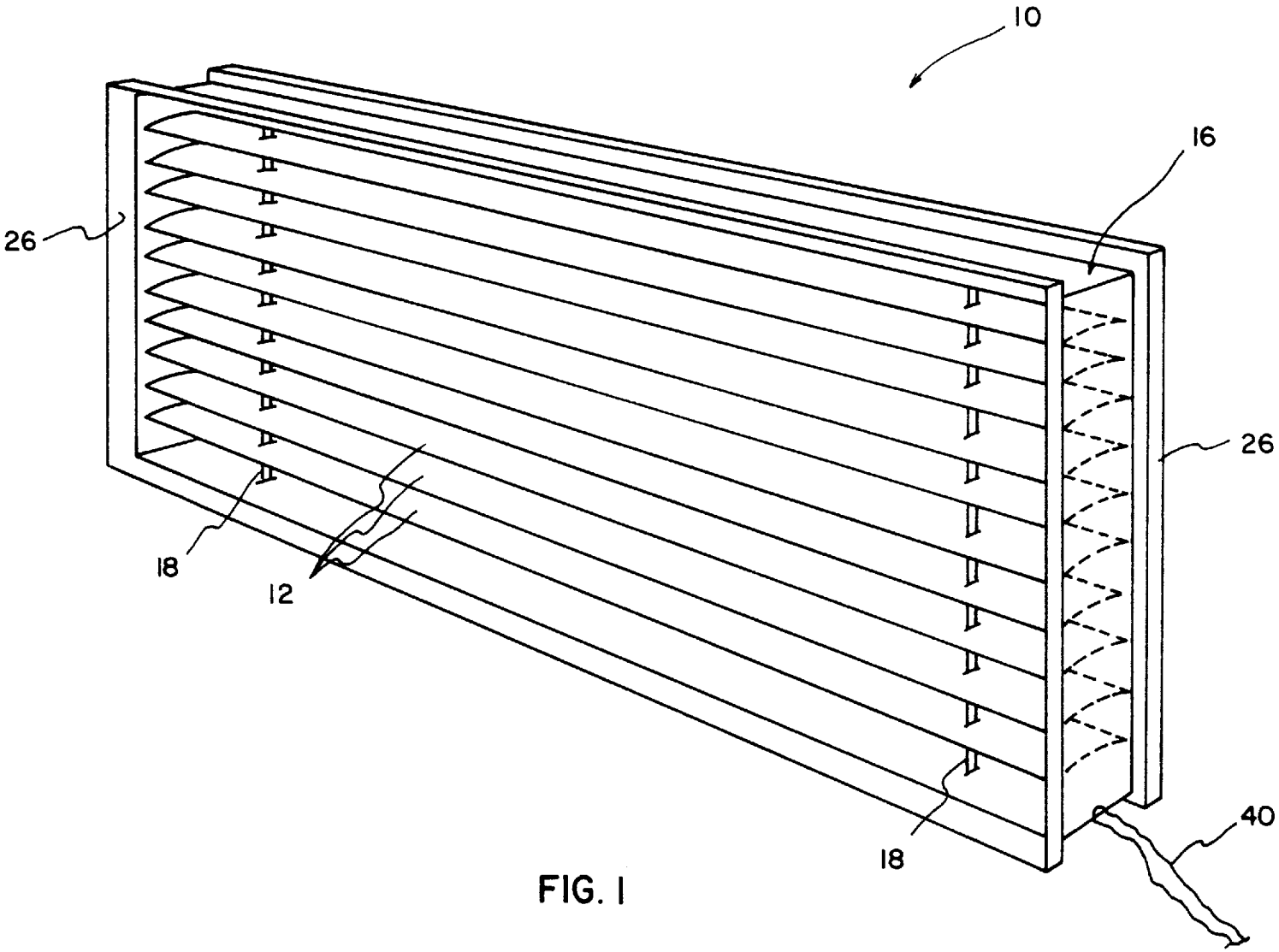
FIG. 1 is a perspective view of the electrically controlled blind system of the present invention.

With further reference to the drawings, there is shown therein an electrostatically positioned blind system in accordance with the present invention, illustrated in FIG. 1 and indicated generally at 10.

In the preferred embodiment the blind system 10 includes a plurality of elongated, rectangular louvers 12 arranged in parallel relation and being adapted for pivoting movement about their respective longitudinal axes A which extend parallel to the center line of each louver 12. The louvers are spaced at regular intervals such that each louver 12 slightly overlaps the abutting edge of each adjacent louver thereby providing for the complete closure of the opening or chamber 14 within the peripheral support frame.

In the preferred embodiment, louvers 12 are concave/convex in configuration and are fabricated from an electroconductive material such as aluminum or other suitable material capable of conducting an applied electrostatic charge.

Figure 2:
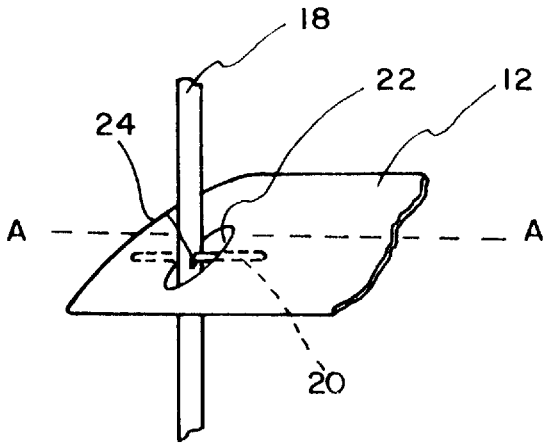
FIG. 2 is an enlarged perspective view of one embodiment of the blind system of the present invention showing the details of the construction thereof.

Each individual louver 12 is supported in pivoting relation about its respective longitudinal axis A on a plurality of louver support columns 18 as are clearly shown in FIG. 2.

In one embodiment each louver 12 is pivotally supported in an unbalanced condition by a plurality of pivot pins 20 which extend longitudinally in generally parallel relation to the axis A of each louver 12 at a predetermined offset distance.

Pins 20 are fabricated from a light gauge, round stock material such as steel or aluminum. In a preferred manufacturing process pins 20 consist of common staples or other similar fasteners which are installed through each respective louver 12 in transverse relation to each respective mounting aperture 22 formed therein.

It will be appreciated by those skilled in the art that apertures 22 are generally oblong in configuration to provide sufficient clearance for support columns 18 to be inserted through each respective louver 12 with pins or staples 20 pre-installed during an assembly procedure of the blind system 10.

Still referring to the embodiment shown in FIG. 2 it can be seen that pins or staples 20 are adapted for pivoting engagement within a plurality of slots 24 formed at regular intervals on louver support columns 18.

Of course, the particular embodiment depicted in FIG. 2 is intended as merely illustrative of the pivoting movement of the individual louvers 12 and is not intended to be limiting or restrictive in any sense in that other configurations are within the scope of the present invention.

It will be appreciated by those skilled in the art that the offset location of pins 20 in relation to longitudinal axis A causes the louvers 12 to be biased downwardly and away from the insulated glass 26 by the force of gravity before an electrostatic charge is applied as set forth hereinafter in further detail.

For purposes of this Application the term "glass" shall refer to either glass or screen and the term "glass plane" shall refer to the plane of the "glass" whether or not glass material is utilized in a particular embodiment.

Figure 3:
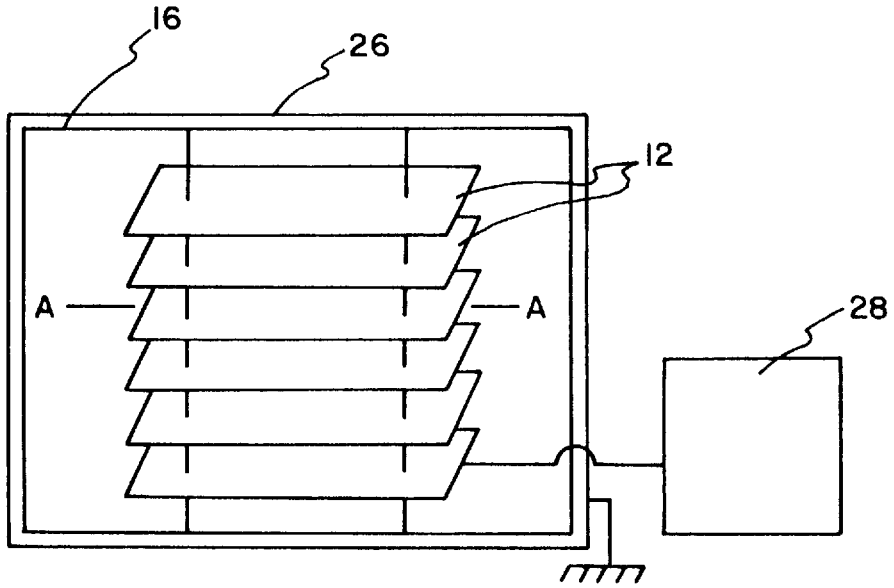
FIG. 3 is a schematic representation of the blind system of the present invention before an electrostatic charge is applied.

Turning now to FIG. 3 there is shown therein a schematic representation of the electrostatically controlled blind system 10 including the glass 26 before any electrostatic charge has been applied thereto. It will be understood that the individual louvers 12 are pivotally supported by the louver support columns 18 such that louvers 12 are pivotable toward the glass 26 and away from the glass 26 as the electrostatic charge is alternately applied and removed. However, the normal or at rest position of the louvers 12 is downward and away from the glass 26 due to the offset position of the pivot pins 20 as depicted schematically in FIG. 3.

A voltage control device 28 is electrically connected to the peripheral support frame 16 having the conductive louver support columns 18 and louvers 12 installed therein. The voltage control device 28 is connected to a standard source of electrical power such as 120 Volt alternating current.

In the preferred embodiment the voltage control device 28 is comprised of a circuit containing a voltage converter (not shown) to step up the voltage output to levels associated with the application of electrostatic charge. The voltage converter typically steps up the voltage to the 0–15 kV range.

Since such voltage control devices employing a voltage converter to convert alternating current to an electrostatic charge are well known to those skilled in the art, further detailed discussion of the same is not deemed necessary.

Figure 4:
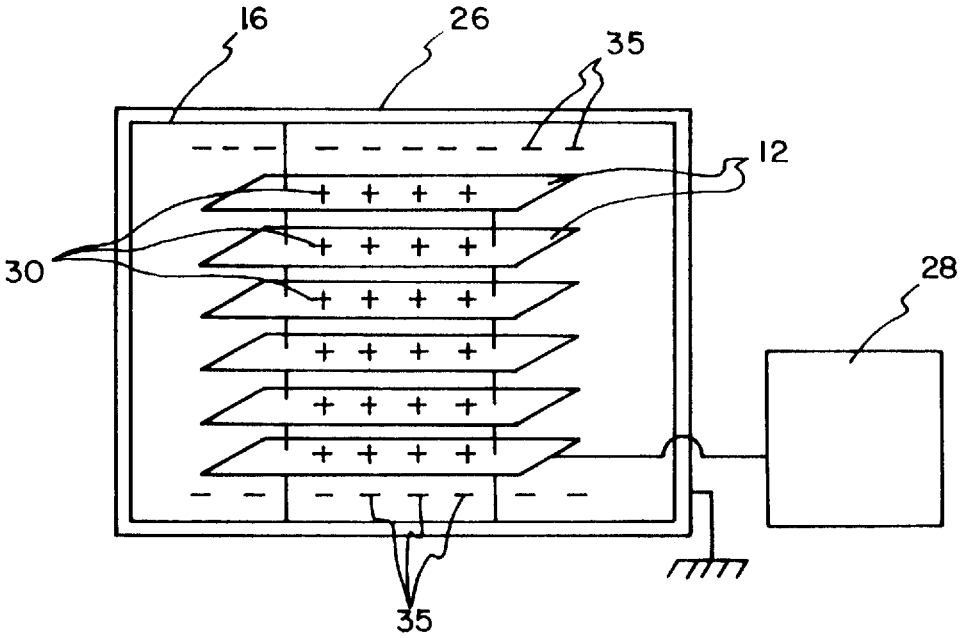
FIG. 4 is a schematic representation of the blind system shown in FIG. 2 after an electrostatic charge has been applied.

Referring now to FIG. 4, there is shown therein a schematic representation of the blind system 10 of the present invention after an electrostatic charge indicated by a plus (+) symbol as at 30, has been applied to the blind system 10. Once the electrostatic charge (+) is delivered to the louvers 12 it will be naturally distributed over the upper and lower surfaces of the louvers 12 causing them to repel one another. The positive (+) electrostatic charge on the louvers 12 induces an opposite negative electrostatic charge, indicated herein by a minus (−) symbol as at 35, on the sheets of insulated glass 26.

Because the negatively charged sheets of glass 26 are positioned in close proximity to the positively charged louvers 12, an electrostatic force of attraction between the louvers 12 and the glass is created. The combined effect of the electrostatic force of repulsion between the positively charged louvers 12 and the electrostatic force of attraction between the positively charged louvers and the negatively charged glass enables the blind system 10 to be variably adjusted to admit the desired amount of light.

The present invention was reduced to practice in an experiment that consisted of twenty-five 1"×22" aluminum louvers spaced ⅞ inch apart as represented schematically in FIG. 3. A conductive sheet of glass 26 commonly called "low-E" glass was positioned approximately ⅛ inch from the louvers in their activated state. The offset position of the pivot pins 20 as described hereinabove created an unbalanced condition in the louvers 12 which caused them to rotate downwardly and away from the glass 26 to a closed condition in the absence of an applied electrostatic charge.

In the presence of the electrostatic charge, the induced electrostatic charge on the glass 26 caused the louvers 12 to rotate upwardly toward the glass to an open position.

The positioning of the louvers 12 depends on the amount of electrostatic charge applied. Thus, quantities of an electrostatic charge less than a minimum amount leave louvers 12 positioned in their at rest condition away from the glass 26 as shown in FIG. 3. Quantities of electrostatic charge greater than a maximum amount leave the louvers 12 positioned toward the glass plane 26 as shown in FIG. 4.

Intermediate amounts of charge leave the louvers 12 in intermediate positions (not illustrated).

In the above described experiment a maximum of 2.5 kilovolts left the louvers 12 in their closed position and a minimum of 11.2 kilovolts was required to fully open the louvers 12. The louvers were three quarters open using 7.2 kilovolts, one half open using 5.6 kilovolts and one quarter open using 4.1 kilovolts.

In the above experiment the electrostatic charge was produced using a voltage converter that converted 10 volts of alternating current to 12 volts of direct current. Thereafter the 0–12 volts of direct current was converted to 0–30 kilovolts of electrostatic charge.

In the above experiment the current associated with the 0–12 volts was 0.004–0.068 amperes such that the power to produce the electrostatic charge was bounded above by 12(0.068)=0.816 watts.

It will be seen that the above formula defines one method of coordinating the control of the position of the louvers with the application of the electrostatic charge, but there are other variations which may be employed.

Figure 5:
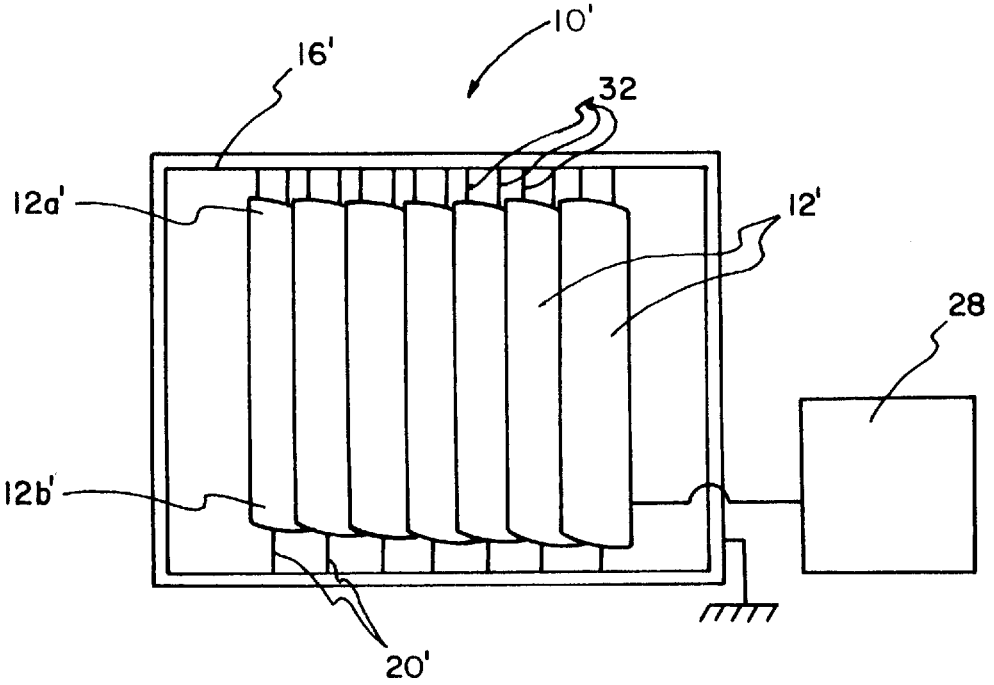
FIG. 5 is a schematic representation of an alternative embodiment of the blind system having vertically configured louvers.

Referring now to FIG. 5 there is shown therein a schematic representation of an alternative embodiment of the electrostatically positioned blind system, indicated generally at 10'. Louvers 12' are vertically disposed in generally parallel, partially overlapping relation. In this embodiment the individual louvers 12' are pivotally supported and adapted for rotation about their longitudinal axes A' by a plurality of suspension wires 32. In this arrangement each individual louver 12' is suspended within a peripheral support frame 16'.

Suspension wires 32 are fabricated from a flexible, electroconductive material and fastened at one end thereof to the peripheral support frame 16' and at the opposite end thereof to the upper ends 12*a'* of louvers 12' so as to provide an electrical pathway from the voltage control device 28 for the application of an electrostatic charge to the louvers.

Figure 6:
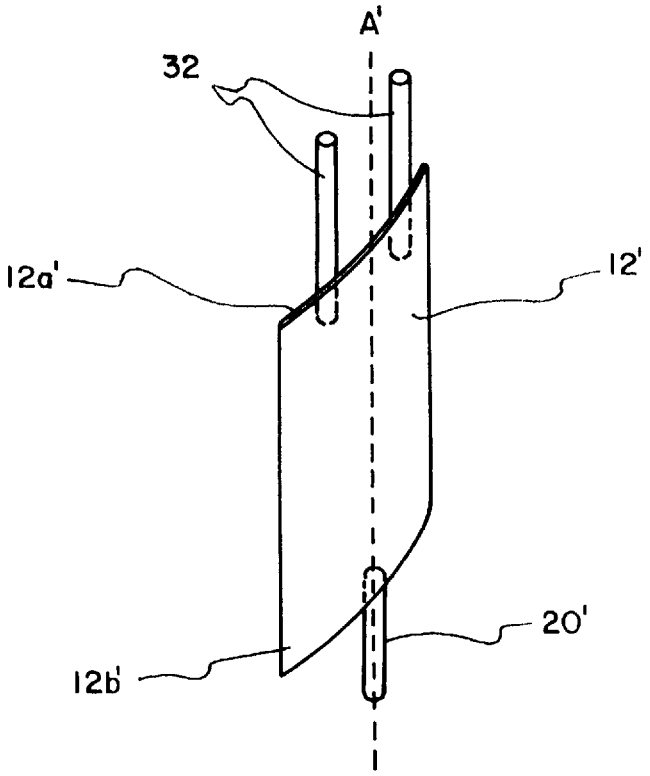
FIG. 6 is an enlarged perspective view of the alternative embodiment of the blind system depicted in FIG. 5 showing details of a vertically configured louver.
Figure 7:
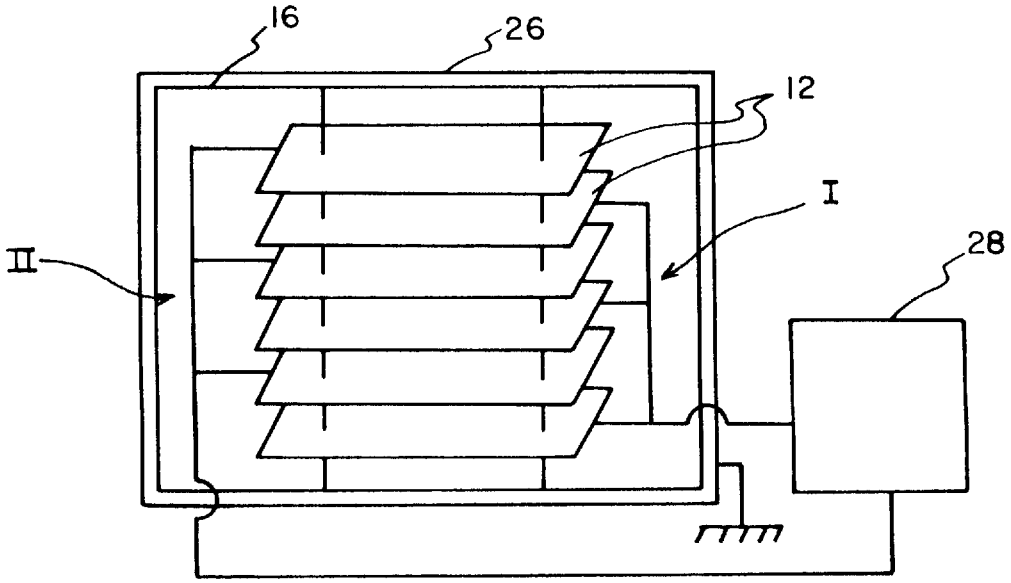
FIG. 7 is a schematic representation of an alternative embodiment of the present invention showing a plurality of louvers arranged in electrically isolated circuits.

The lower ends 12*b'* of louvers 12' are provided with a pivot pin 20' as more clearly shown in FIG. 6. Pivot pin 20' is also fabricated from an electroconductive material and is fastened to the lower end of each louver 12' in a known manner. Pivot pins 20' are disposed in physical contact with support frame 16' and are adapted for pivoting engagement therewith to permit free rotation of the louvers 12' when an electrostatic charge is applied to the blind system 110'.

In the absence of an electrostatic charge the louvers 12' are suspended in an overlapping, closed condition as shown in FIG. 5. Once an electrostatic charge has been applied to the louvers 12' as described hereinabove, the louvers will repel each other.

In similar fashion the electrostatic charge on the louvers 12' induces an opposite electrostatic charge on the grounded sheets of glass 26 thereby creating an electrostatic force of attraction which causes the louvers 12' to rotate toward the glass 26. It will be appreciated that the rotation of louvers 12' toward the glass 26 causes the louvers 12' to be raised slightly in an upward direction due to the fixed length of wires 32. Thereafter, if the electrostatic is reduced or turned off, the louvers 12' will rotate in the opposite direction due to force of gravity back to the closed or at rest condition.

It will be appreciated by those skilled in the art that alternative electrical circuits car be utilized within the scope of the present invention to position isolated groups of louvers within the blind system 10. For example, alternating louvers 12 within the system may be electrically connected as shown in FIG. 6, indicated generally as Group I and Group II, and arranged in discrete circuits which are electrically connected to the control means 28.

When the two Groups I and II are electrostatically charged the same amount, that is, when the same voltage is applied to each group, the louvers 12 within each Group I and II will repel each other and will rotate toward the glass plane to an open condition.

When the two groups I and II are electrostatically charged different amounts, that is, when different voltages are applied to each group, the Groups I and II will attract each other and the louvers 12 will rotate away from the glass plane to a closed condition.

The above example illustrates the situation in which the electrostatic force is utilized to rotate the louvers 12 both away from the glass plane and toward the glass plane. The division of the blind system into a plurality of groups, such as the two groups described hereinabove, enables groups of louvers within the system to be positioned independently of one another.

From the above it can be seen that the present invention provides a practical method and apparatus for electrostatic control of a blind system for use in residential and commercial buildings.

The present invention provides an electrostatically controlled blind system which can be adapted to windows, doors, skylights, and other openings during initial manufacturing or on a retrofit basis in existing buildings.

Further, the present invention provides an electrostatically controlled blind system which significantly reduces the number of components found in the electrically powered blind systems of the prior art which simplifies manufacturing and reduces associated costs.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

That which is claimed is:

1. An electrostatically controlled blind system comprising:

a plurality of elongated, electroconductive louvers each having a longitudinal axis, each of said louvers having a plurality of apertures formed therein at predetermined locations, said louvers further including pivoting means installed thereon in generally parallel relation to said longitudinal axis at a predetermined offset position in relation thereto;

a plurality of vertically disposed louver supporting means installed within said apertures and being disposed in pivoting engagement with said pivoting means such that said louvers are horizontally arranged in parallel, spaced apart relation, said louvers being supported in an unbalanced condition and biased downwardly about said axis to a closed condition due to gravitational force;

at least one sheet of electroconductive glass positioned in a plane parallel to a plane defined by said longitudinal axes of said louvers and in close proximity thereto, said glass being disposed in electrical connection to said louvers and being electrically grounded; and a variable electrostatic power source being electrically connected to said louvers such that when an electrostatic charge is applied to said louvers, an opposite electrostatic charge is induced on said glass creating an electrostatic force of attraction between said louvers and said glass enabling said louvers to be rotatably positioned about said axis to an open condition whereby the passage of light therethrough can be regulated.

2. The blind system of claim 1 wherein said louvers rotate back to said closed condition by gravitational force when said applied electrostatic charge is removed from said louvers.

3. The blind system of claim 2 wherein said louvers are fabricated from a light weight aluminum material.

4. The blind system of claim 3 wherein said louvers are concave/convex in cross-section.

5. The blind system of claim 2 wherein said pivoting means includes a staple fastener installed through said louvers in transverse relation to said apertures.

6. The blind system of claim 2 wherein said louvers and said louver supporting means are disposed between a pair of parallel, electroconductive glass sheets arranged in close proximity thereto, said glass sheets being sealed about the peripheral edges thereof to define an air space wherein said blind system is isolated from the ambient atmosphere.

7. The blind system or claim 1 wherein said louvers are arranged in a plurality of electrically isolated circuits, each of said circuits being electrically connected to said power source such that when an equal voltage is applied to each of said circuits, said louvers within said isolated circuits will repel each other causing said louvers to rotate toward said glass to an open condition and when unequal voltages are applied to each of said circuits, said louvers within each of said respective circuits will be attracted to each other causing said louvers to rotate away from said glass to a closed condition.

8. An electrostatically controlled blind system comprising:

a plurality of elongated, electroconductive louvers each having a longitudinal axis, said louvers being oriented vertically in parallel, spaced apart relation;

a plurality of louver supporting means including suspension wire means being attached at an upper end of each respective louver, said louver supporting means further including a pivot post means attached to a lower end of said louvers such that said louvers are imparted with rotational movement about said longitudinal axes;

at least one sheet of electroconductive glass positioned in a plane parallel to a plane defined by said longitudinal axes of said louvers and in close proximity thereto, said glass being disposed in electrical connection with said louvers and being electrically grounded; and a variable electrostatic power source being electrically connected to said louvers such that when an electrostatic charge is applied thereto, an opposite electrostatic charge is induced on said glass creating an electrostatic force of attraction between louvers and said glass enabling said louvers to be rotatably positioned about said axis whereby the passage of light therethrough can be regulated.

* * * * *